United States Patent [19]

Ferrero

[11] 4,257,715

[45] Mar. 24, 1981

[54] BINDER ASSEMBLY

[75] Inventor: Robert I. Ferrero, Imperial, Mo.

[73] Assignee: Loose Leaf Metals Co., Inc., St. Louis, Mo.

[21] Appl. No.: 758,192

[22] Filed: Jan. 10, 1977

[51] Int. Cl.[3] ..... B42F 3/02; B42F 13/30

[52] U.S. Cl. ..... 402/47

[58] Field of Search ..... 402/47, 46, 45, 23, 402/61, 68, 63; 292/DIG. 72, 156, 162, 145

[56] References Cited

U.S. PATENT DOCUMENTS

| | | | |
|---|---|---|---|
| 957,895 | 5/1910 | Murphy | 402/64 |
| 1,337,513 | 4/1920 | Haldeman | 292/DIG. 72 |
| 2,784,719 | 3/1957 | Panfil | 402/47 |
| 2,915,068 | 12/1959 | Miyamoto | 402/45 |

*Primary Examiner*—Stephen C. Pellegrino
*Attorney, Agent, or Firm*—Cohn, Powell & Hind

[57] ABSTRACT

A binder assembly for catalogs and the like having a base plate provided with opposed side flanges, one of which is fixed and the other of which is hinged. A material-holding device is connected to the hinged flange and is movable to an open position and to a closed position relative to the fixed flange. A latch interconnects the fixed flange and the material-holding device for selectively locking the material-holding device in a closed position, the latch automatically locking the material-holding device in its closed position as the material-holding device is moved to the closed position, and automatically ejecting the material-holding device from its closed position when unlocked. The material-holding device includes a lock lug. The latch includes a slot in the fixed flange, and a locking element mounted adjacent the fixed flange for movement between a locked position and an unlocked position relative to the fixed flange, the locking element being provided with a slot that is aligned with the fixed flange slot for receiving the lock lug when the locking element is in its unlocked position. A cam surface partially defines the locking element slot, and is engageable with the lug for automatically moving the locking element to its locked position and locking the lug as the material-holding device is moved to its closed position, and for automatically unlocking and ejecting the lug from the slots as the locking element is moved to its unlocked position.

2 Claims, 5 Drawing Figures

BINDER ASSEMBLY

BACKGROUND OF THE INVENTION

This invention relates generally to improvements in a binder assembly, and more particularly to an improved catalog binder assembly which facilitates the opening and closing of the component parts incident to placement and removal of catalogs, papers and the like.

The heretofore conventional type of catalog binder required a separate positive actuation of the latch for locking the material-holding device in its closed position, and required a positive, separate disengagement of the material-holding device from the latch after the latch has been moved to its unlocked position.

SUMMARY OF THE INVENTION

In the present binder assembly, as the material-holding means is moved to its closed position, the material-holding means will automatically actuate the latch to its locked position so as to lock the material-holding means in its closed position. Moreover, when the latch is moved to its unlocked position, the latch will automatically unlock and eject the material-holding means from its closed position.

The binder assembly includes a material-holding means connected to a flange hinged to a base plate means, and movable to an open position and a closed position relative to a fixed flange. A latching means interconnects the fixed flange and the material-holding means for selectively locking the material-holding means in a closed position, the latching means automatically locking the material-holding means in its closed position as the material-holding means is moved to the closed position, and automatically ejecting the material-holding means from its closed position when unlocked.

The latching means includes a slot in the fixed flange, and a locking element movable between a locked position and an unlocked position, the locking element having a slot at least partially defined by a cam surface. The slots are aligned when the locking element is in its unlocked position for receiving a lock lug on the material-holding means, the lug and cam surface engaging for automatically locking and automatically ejecting the lock lug.

The cam surface is disposed angularly to the direction of movement of the locking element, and the slot in the locking element is at least partially defined by an overlying latch arm portion for locking the lug in the slot when the locking element is in its locked position.

More particularly, the fixed flange slot has an edge opening that is aligned with an edge opening of the locking element slot, when the locking element is in its unlocked position, for receiving the lock lug, the locking element being mounted adjacent the fixed flange. The cam surface and lock lug engage for automatically moving the locking element to its locked position and locking the lug as the material-holding means is moved to its closed position, and for automatically unlocking and ejecting the lug from the slots as the locking element is moved to its unlocked position.

DESCRIPTION OF THE PREFERRED EMBODIMENT

Figure 1:
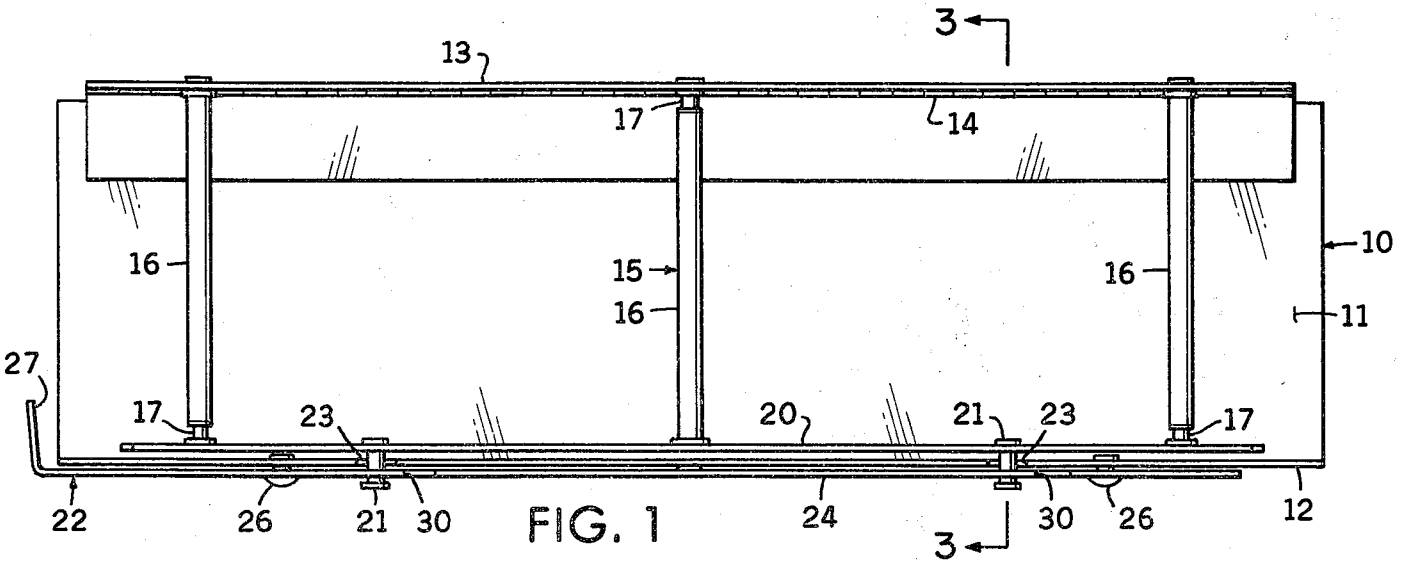
FIG. 1 is a top plan view of the binder assembly.

The binder assembly includes an elongate substantially U-shaped base plate means generally indicated by 10 having a web back portion 11 and opposed side flanges 12 and 13. The flange 12 is fixed to the web 11. The flange 13 is hingedly connected to the web 11 by a hinge 14.

Carried by the hinged flange 13, is a material-holding means referred to by 15 adapted to hold catalogs, papers and the like. This material-holding means 15 includes a first set of post members 16 fixed at one end to the fixed flange 13 in longitudinally spaced relation. In the embodiment disclosed, there are three such post members 16. A second cooperating set of post members 17 are telescopically related and connected to the post members 16, the second set of post members 17 being carried by and fixed to an elongate closure strip 20.

Figure 2:
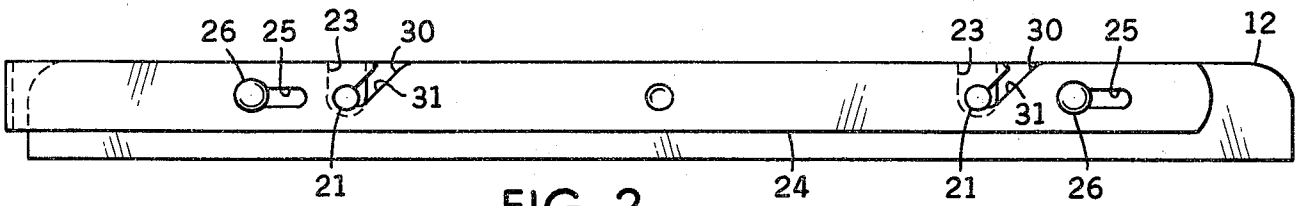
FIG. 2 is a side elevational view of FIG. 1, showing the component parts latched.
Figure 3:
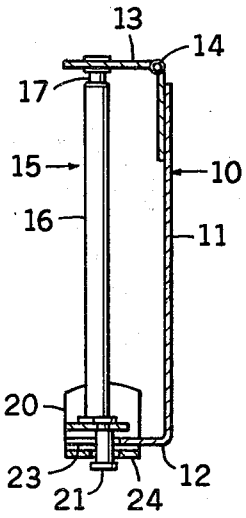
FIG. 3 is a cross-sectional view as seen on line 3—3 of FIG. 1.
Figure 4:
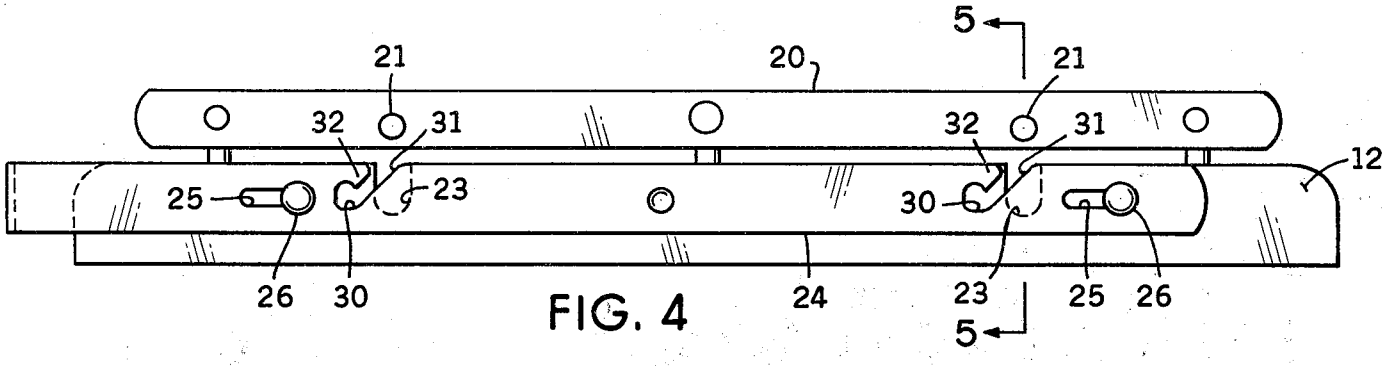
FIG. 4 is a side elevational view similar to FIG. 2, but showing the component parts unlatched.
Figure 5:
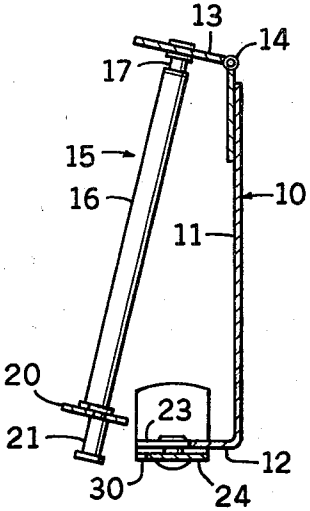
FIG. 5 is a cross-sectional view as seen on line 5—5 of FIG. 4.

To use the material-holding means 15, the post members 16–17 and closure strip 20 are raised to an open position as shown in FIG. 4 about the hinge 14. Then, the closure strip 20 and its associated post members 17 can be disengaged from the cooperating post members 16. The catalogs and papers can then be inserted over the first set of post members 16, and are held in place when the post members 17 are re-engaged with the cooperating post members 16. The material-holding means 15 is then moved to a closed position as is illustrated in FIG. 2, in which the closure strip 20 is located adjacent to the fixed flange 12.

Fixed to and carried by the closure strip 20, is a pair of lock lugs 21 extending laterally outward and transversely of the fixed flange 12.

A latching means generally indicated by 22, operatively interconnects the fixed flange 12 and the material-holding means 15 for selectively locking the material-holding means 15 in the closed position. This latching means 22 includes a pair of spaced slots 23 formed in the fixed flange 12. The slots 23 have top edge openings for receiving the lock lugs 21.

Slidably mounted to the base plate means 10, and particularly to the fixed flange 12, is an elongate locking element 24. The slide mounting includes a pair of longitudinally extending, elongate slots 25 receiving stud pins 26 attached to the fixed flange 12. The locking element 24 is movable relative to the fixed flange 12 between a locked position shown in FIG. 2 and an unlocked position shown in FIG. 4. The locking element 22 includes an in-turned tab 27 at one end to facilitate actuation.

Formed in the locking element 24 is a cooperating pair of slots 30, the slots 30 having top edge openings alignable with the top edge openings of the associated fixed flange slots 23, when the locking element 24 is in its unlocked position, for receiving the lock lugs 21. Each slot 30 in the locking element 24 is at least partially defined by a cam surface 31 inclined angularly to the direction of movement of the locking element 24. The cam surface 31 is engageable with the associated lock lug 21 for automatically moving the locking element 24 to its locked position and locking the lug 21 as the material-holding means 15 is moved to its closed position, and for automatically unlocking and ejecting the lug 21 from the slot 30 as the locking element 24 is moved to its unlocked position. Each slot 30 in the locking element 24 is at least partially defined by an overlying latch arm portion 32 for locking the associated lug 21 in the slot 30 when the locking element 24 is in its locked position.

It is thought that the advantages and functional cooperation of the component parts have become fully apparent from the foregoing detailed description, but for completeness of disclosure the operation of the latching means 22 will be briefly described. It will be assumed that the locking element 24 is in its unlocked position shown in FIG. 4, and that the desired catalogs and papers have been placed on the cooperating post members 16–17 in the manner previously described.

Then, the material-holding means 15 is swung downwardly from its open position shown in FIG. 4 to its closed position, the closure strip moving downwardly into adjacency with the fixed flange 12, and the lock lugs 21 moving into the aligned top edge openings of the cooperating slots 23 and 30. As the lugs 21 enter the aligned slots 23 and 30, the lugs 21 engage the cam surfaces 31 of the slots 30 and automatically move the locking element 24 from its unlocked position shown in FIG. 4 to its locked position shown in FIG. 2. Simultaneously, the lock lugs 21 move to the bottom of the slots 30 and underneath the overlying latch arm portions 32. The lock lugs 21, and hence the material-holding means 15, are now locked in place.

To unlock the material-holding means 15, the locking element 24 is moved digitally from its locked position shown in FIG. 2 to its unlocked position shown in FIG. 4. During this unlocking movement of the locking element 24, the cam surfaces 31 engage and automatically eject the lugs 21 from the slots 23 and 30.

I claim as my invention:

1. A binder assembly, comprising:

(a) base means providing opposed side flanges, one of the flanges being fixed and the other flange being hinged, (b) material-holding means connected to the hinged flange, and movable to an open position away from the fixed flange and to a closed position adjacent the fixed flange, the material-holding means including a lock lug, and (c) latching means interconnecting the fixed flange and material-holding means in the closed position, including:

(1) an edge-open slot in the fixed flange for receiving the lock lug, and (2) a locking element slidably mounted for linear movement adjacent the fixed flange, the locking element having an edge-open slot aligned with the edge-open slot of the fixed flange in an unlocked position of the locking element, the slot of the locking element being at least partially defined by a cam surface inclined angularly to the direction of movement of the locking element and movable across the edge-open slot of the fixed flange as the locking element is moved linearly, the same cam surface engaging the lock lug as the lock lug is moved into the slot of the fixed flange to move the locking element linearly in one direction to a locked position in which the edge-open slots are misaligned, and also engaging the lock lug to eject the lock lug from the edge-open slots as the locking element is moved linearly in the opposite direction to the unlocked position in which the edge-open slots are aligned.

2. A binder assembly as defined in claim 1, in which:

(d) the slot in the locking element is at least partially defined by a latch arm portion misaligned with the edge-open slot in the fixed flange in the unlocked position of the locking element, and overlapping the lock lug and blocking the edge-open slot in the fixed flange in the locked position of the locking element for latching the lock lug and precluding movement of the locking element by the lock lug toward its unlock position.

* * * * *